US010619471B2

(12) United States Patent
Kajaria et al.

(10) Patent No.: US 10,619,471 B2
(45) **Date of Patent: *Apr. 14, 2020**

(54) REMOTE MOBILE OPERATION AND DIAGNOSTIC CENTER FOR FRAC SERVICES

(71) Applicant: GE Oil & Gas Pressure Control LP, Houston, TX (US)

(72) Inventors: Saurabh Kajaria, Houston, TX (US); Jacob Clifton, Houston, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/384,149

(22) Filed: Apr. 15, 2019

(65) Prior Publication Data

US 2019/0292891 A1 Sep. 26, 2019

Related U.S. Application Data

(63) Continuation of application No. 14/725,341, filed on May 29, 2015, now Pat. No. 10,260,327.
(Continued)

(51) Int. Cl.
*E21B 34/02* (2006.01)
*E21B 41/00* (2006.01)
(Continued)

(52) U.S. Cl.
CPC ..... *E21B 43/26* (2013.01); *E21B 34/02* (2013.01); *E21B 41/0092* (2013.01); *E21B 47/00* (2013.01)

(58) Field of Classification Search
CPC ..... E21B 43/26; E21B 34/02; E21B 41/0092; E21B 43/168; E21B 43/30; E21B 47/00
See application file for complete search history.

(56) References Cited

U.S. PATENT DOCUMENTS 3,552,903 A 1/1971 Townsend
3,643,736 A 2/1972 Talley
(Continued)

FOREIGN PATENT DOCUMENTS

GB 2233365 1/1991
WO 199003490 4/1990
(Continued)

OTHER PUBLICATIONS

International Search Report and Written Opinion issued in connection with corresponding PCT Application No. PCT/US2015/033492, dated Dec. 15, 2015.

*Primary Examiner* — Daniel P Stephenson
(74) *Attorney, Agent, or Firm* — Hogan Lovells US LLP

(57) ABSTRACT

A method for remotely controlling services to a well during hydraulic fracturing operations includes generating a high pressure fluid and pumping the high pressure fluid into a subterranean geologic formation through a wellbore of a first well, the high pressure fluid being provided at a sufficient pressure to fracture the subterranean geologic formation. The method also includes performing a service on a second well, the second well being located within a pressure zone defined around the first well and the second well. The method further includes controlling the performance of the service from a remote operations hub.

20 Claims, 5 Drawing Sheets

Related U.S. Application Data

(60) Provisional application No. 62/005,720, filed on May 30, 2014, provisional application No. 62/006,681, filed on Jun. 2, 2014, provisional application No. 62/092,543, filed on Dec. 16, 2014.

(51) Int. Cl.
*E21B 43/26* (2006.01)
*E21B 47/00* (2012.01)

(56) References Cited

U.S. PATENT DOCUMENTS

| | | | | |
|---|---|---|---|---|
| 3,777,812 | A | 12/1973 | Burkhardt | |
| 4,848,474 | A | 7/1989 | Parizot | |
| 8,220,553 | B2 | 7/2012 | Crawford | |
| 9,052,061 | B2 | 6/2015 | He | |
| 9,315,372 | B2 | 4/2016 | Doi et al. | |
| 9,840,901 | B2 * | 12/2017 | Oehring | E21B 43/26 |
| 10,260,327 | B2 * | 4/2019 | Kajaria | E21B 41/0092 |
| 2006/0124300 | A1 | 6/2006 | Steiner | |
| 2009/0050311 | A1 | 2/2009 | Crawford | |
| 2009/0266554 | A1 | 10/2009 | Wilson | |
| 2010/0032031 | A1 | 2/2010 | Neal | |
| 2010/0051272 | A1 | 3/2010 | Loree | |
| 2011/0030963 | A1 | 2/2011 | Demong | |
| 2012/0160499 | A1 | 6/2012 | Tirio | |
| 2012/0181046 | A1 | 7/2012 | Kajaria | |
| 2013/0233560 | A1 | 9/2013 | Davidson | |
| 2014/0352968 | A1 | 12/2014 | Pitcher | |
| 2015/0007995 | A1 | 1/2015 | Livescu | |
| 2015/0114652 | A1 | 4/2015 | Lestz | |
| 2015/0136409 | A1 | 5/2015 | Hall | |
| 2015/0345272 | A1 | 12/2015 | Kajaria | |
| 2016/0061016 | A1 | 3/2016 | Ciezobka | |
| 2016/0102537 | A1 | 4/2016 | Lopez | |
| 2016/0329697 | A1 | 11/2016 | Brooks | |
| 2017/0022788 | A1 * | 1/2017 | Oehring | E21B 41/0021 |
| 2017/0234335 | A1 | 8/2017 | LeBlanc | |
| 2018/0156004 | A1 | 6/2018 | Hussain | |
| 2018/0258742 | A1 | 9/2018 | Sveberg | |

FOREIGN PATENT DOCUMENTS

| | | |
|---|---|---|
| WO | 20140197351 | 12/2014 |
| WO | 2015030757 | 3/2015 |

* cited by examiner

REMOTE MOBILE OPERATION AND DIAGNOSTIC CENTER FOR FRAC SERVICES

CROSS REFERENCE TO RELATED APPLICATION

This application is a continuation of U.S. patent application Ser. No. 14/725,341 filed May 29, 2015, titled "REMOTE MOBILE OPERATION AND DIAGNOSTIC CENTER FOR FRAC SERVICES," now U.S. Pat. No. 10,260,327, issued Apr. 16, 2019, and claims priority to and the benefit of U.S. Provisional Application No. 62/005,720 filed May 30, 2014, titled "Mobile Operation and Diagnostic Center for Frac Services," and U.S. Provisional Application No. 62/006,681 filed Jun. 2, 2014, titled "Mobile Operation and Diagnostic Center for Frac Services," and U.S. Provisional Application No. 62/092,543 filed Dec. 16, 2014, titled "Remote Frac Operations Hub," the full disclosure of each which is hereby incorporated herein by reference in its entirety for all purposes.

BACKGROUND

1. Field of Disclosure

This invention relates in general to producing hydrocarbons from subterranean wells using hydraulic fracturing, and in particular to remote operation and monitoring of well systems during hydraulic fracturing related activities.

2. Description of Related Art

Certain hydrocarbon production related activities, such as well stimulation and hydraulic fracturing, require the pumping of pressurized fluid down hole. During hydraulic fracturing, as an example, a fluid is pumped into a subterranean geologic formation through the wellbore. The fluid is provided at a sufficient pressure to fracture the geologic formation, thus facilitating the recovery of hydrocarbons from the formation. Fluid is pressurized by one or more pumps, which is then pumped down high pressure flow lines to the well bore.

There is a pressure zone identified around the well assemblies, which is a limited access area for safety purposes, due the high pressure options. This makes the regions in the vicinity of the well assemblies inaccessible to most individuals during frac operations. Because of such limited access to the pressure zone during hydraulic fracturing operations, operators face a significant amount of un-planned downtime due to the maintenance requirements and operational demands of hydraulic fracturing trees and manifolds. This results in delayed production and an increase in overall costs.

SUMMARY OF THE DISCLOSURE

Embodiments of the current disclosure provide systems and methods for well mounted equipment to be remotely controlled and operated while hydraulic fracturing operations continue at nearby wells within the pressure zone.

In an embodiment of this disclosure a method for remotely controlling services to a well during hydraulic fracturing operations is disclosed. The method includes the steps of: (a) generating a high pressure fluid and pumping the high pressure fluid into a subterranean geologic formation through a wellbore of a first well, the high pressure fluid being provided at a sufficient pressure to fracture the subterranean geologic formation; (b) performing a service on a second well, the second well being located within a pressure zone defined around the first well and the second well, the service being remotely controlled; and (c) controlling the performance of the service from a remote operations hub. Step (a) and step (b) are performed simultaneously and step (c) is performed from the remote operations hub located outside of the pressure zone.

In an alternate embodiment of this disclosure, a method for remotely controlling services to a well during hydraulic fracturing operations is disclosed. The method includes performing a hydraulic fracturing operation at a first well. The hydraulic fracturing operation includes providing high pressure pumps at a well site. The well site includes the first well, a second well, and a pressure zone that circumscribes both the first well and the second well. The hydraulic fracturing operation also includes using the high pressure pumps to generate a high pressure fluid and to pump the high pressure fluid into a subterranean geologic formation through a wellbore of the first well to fracture the subterranean geologic formation. A remote operations hub is provided outside of the pressure zone. Simultaneously with pumping the high pressure fluid into the subterranean geologic formation through the wellbore of the first well, a service is performed on the second well from the remote operations hub.

In an another alternate embodiment of this disclosure, a system for remotely controlling services to a well during hydraulic fracturing operations is disclosed. A first well is in fluid communication with a high pressure pumping system that is operable to pump high pressure fluid into a subterranean geologic formation through a wellbore of the first well at a sufficient pressure to fracture the subterranean geologic formation. A second well is located within a pressure zone defined around the first well and the second well. A remote operations hub is in communication with the second well and operable to remotely control the performance of a service at the second well during operation of the high pressure pumping system at the first well. The remote operations hub is located outside of the pressure zone.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE DISCLOSURE

Figure 1:
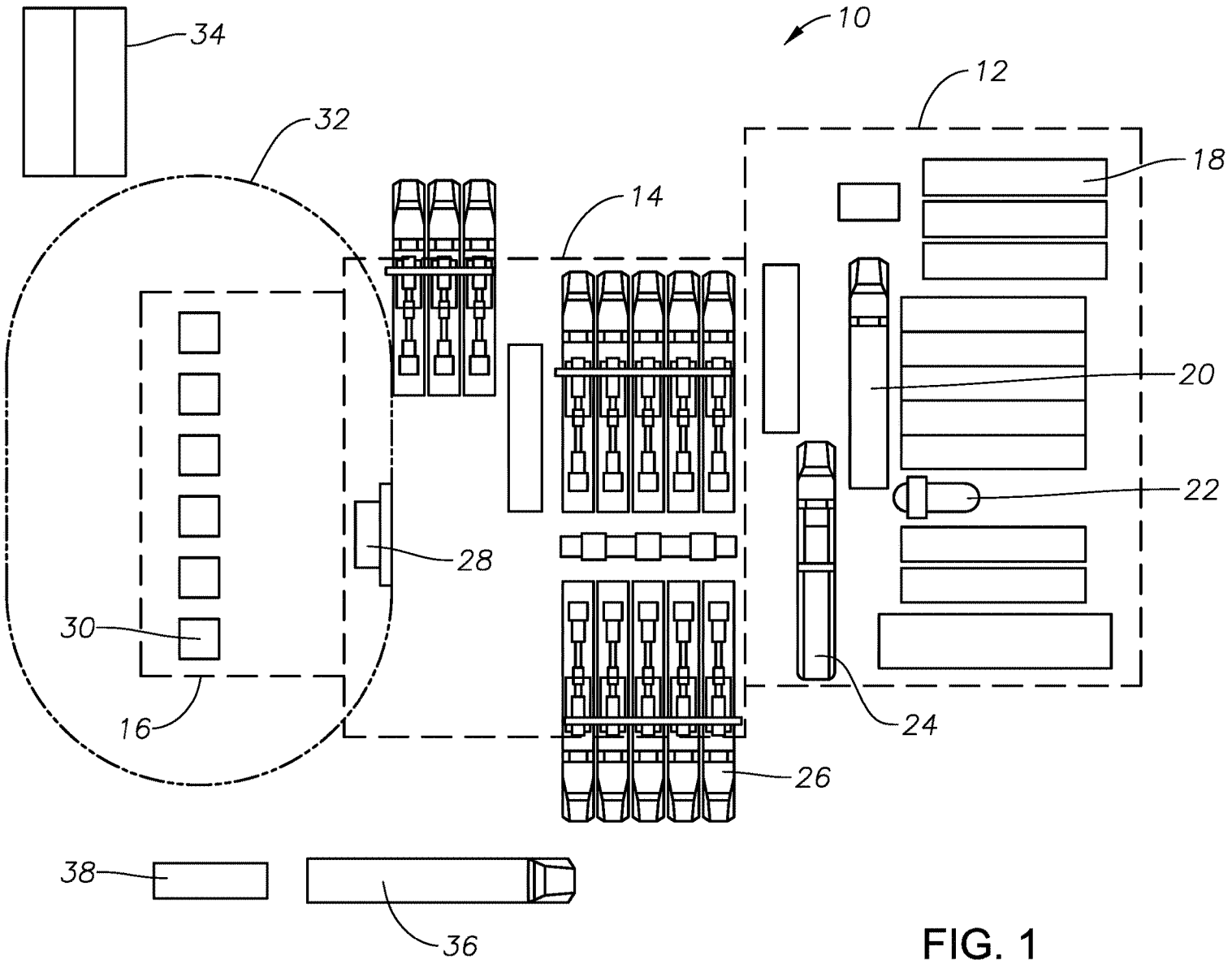
FIG. 1 is a schematic plan view of hydrocarbon wells system during hydraulic fracturing operations with a remote operations hub of in accordance with an embodiment of this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Looking at FIG. 1, a schematic representation of an example layout of a hydraulic fracturing operation system 10 is shown. The example layout of FIG. 1 includes three main areas: hazardous chemical area 12, high pressure pumping area 14 and well area 16. Hazardous chemical area 12 includes tanks 18 and trucks 20 for storing fluids and other chemicals utilized in the hydraulic fracturing operations. Hazardous chemical area 12 can also include a transfer pump 22 for transferring fluids within and out of chemical area 12 and blender 24 for blending and pumping the fluids and other chemicals.

High pressure pumping area 14 includes a series of pump trucks 26 that receive fluids from hazardous chemical area 12. Frac manifold 28 is also located within high pressure pumping area 14. Frac manifold 28 receives the high pressure fluids generated by pump trucks 26 and directs such fluids towards a well 30. Frac manifold 28 can have a fluid communication line with each well 30 and can be operated to select which well 30 is to receive the high pressure fluids. During hydraulic fracturing operations, pump trucks 26 generate a high pressure fluid and pump the high pressure fluid into a subterranean geologic formation through a wellbore of one of the wells 30, by way of frac manifold 28. The high pressure fluid is provided at a sufficient pressure to fracture the subterranean geologic formation.

Well area 16 can include a number of wells. In the example configuration of FIG. 1, six wells are shown, however in alternate embodiments there can be as few as two wells or more than six wells. A pressure zone 32 surrounds wells 30. Pressure zone 32 is a region surrounding wells 30 where due to high pressure operations at wells 30, there is an increased health and safety risk associated with being physically located within the pressure zone 32. Pressure zone 32 can be determined, for example, as the area in which an operator would be within a given number of feet from any of the wells 30. Pressure zone 32 can be a single area that encompass all of the wells 30. For example, if there was only one well 30, and the number of feet from well 30 of applicable heightened health and safety risk is "X" feet, then the pressure zone would be a circle with a radius of "X" feet centered around well 30. During hydraulic fracturing operations, there may therefore be limited operator access to pressure zone 32, for safety reasons. As can be seen in FIG. 1, pressure zone 32 can encompass frac manifold 28 so that there is limited access to frac manifold 28 during hydraulic fracturing operations. There may also be limited operator access to hazardous chemical area 12 due to the risks associated with hazardous chemicals, and limited operator access high pressure pumping area 14 due to risks associated with the high pressure operations.

Outside of hazardous chemical area 12, high pressure pumping area 14 and well area 16, there can be various additional storage tanks 34 and hydraulic fracturing monitoring and control units 36. Remote operations hub 38 can also be a part of hydraulic fracturing operation system 10 and located outside of pressure zone 32 as well as being outside of hazardous chemical area 12 and high pressure pumping area 14. Remote operations hub 38 can contain features required to remotely monitor or control an operation or service that is performed at one of the wells 30 within pressure zone 32. Remote operations hub 38 can remotely control services to one of the wells 30 while hydraulic fracturing operations are being undertaken at another of the wells 30 within pressure zone 32.

Figure 2:
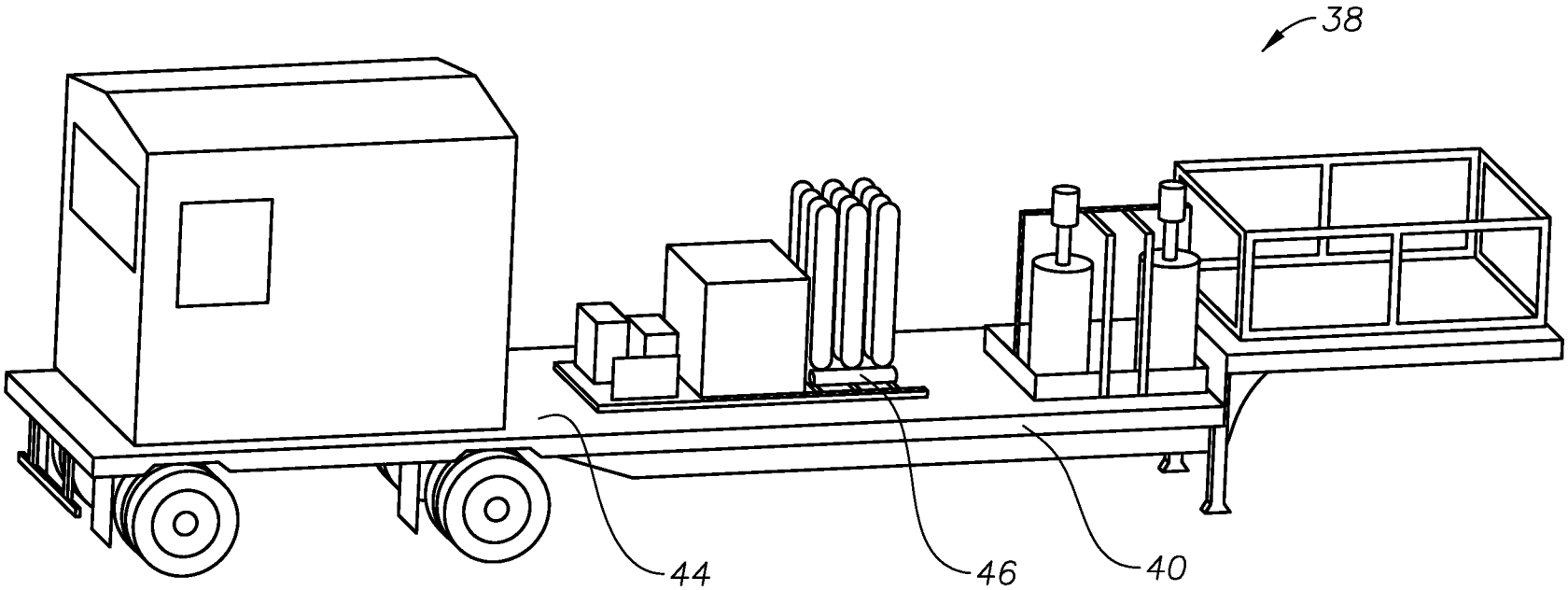
FIG. 2 is a schematic perspective view of a side of a wheeled mobile operation center of the remote operations hub of FIG. 1, in accordance with an embodiment of this disclosure.
Figure 4:
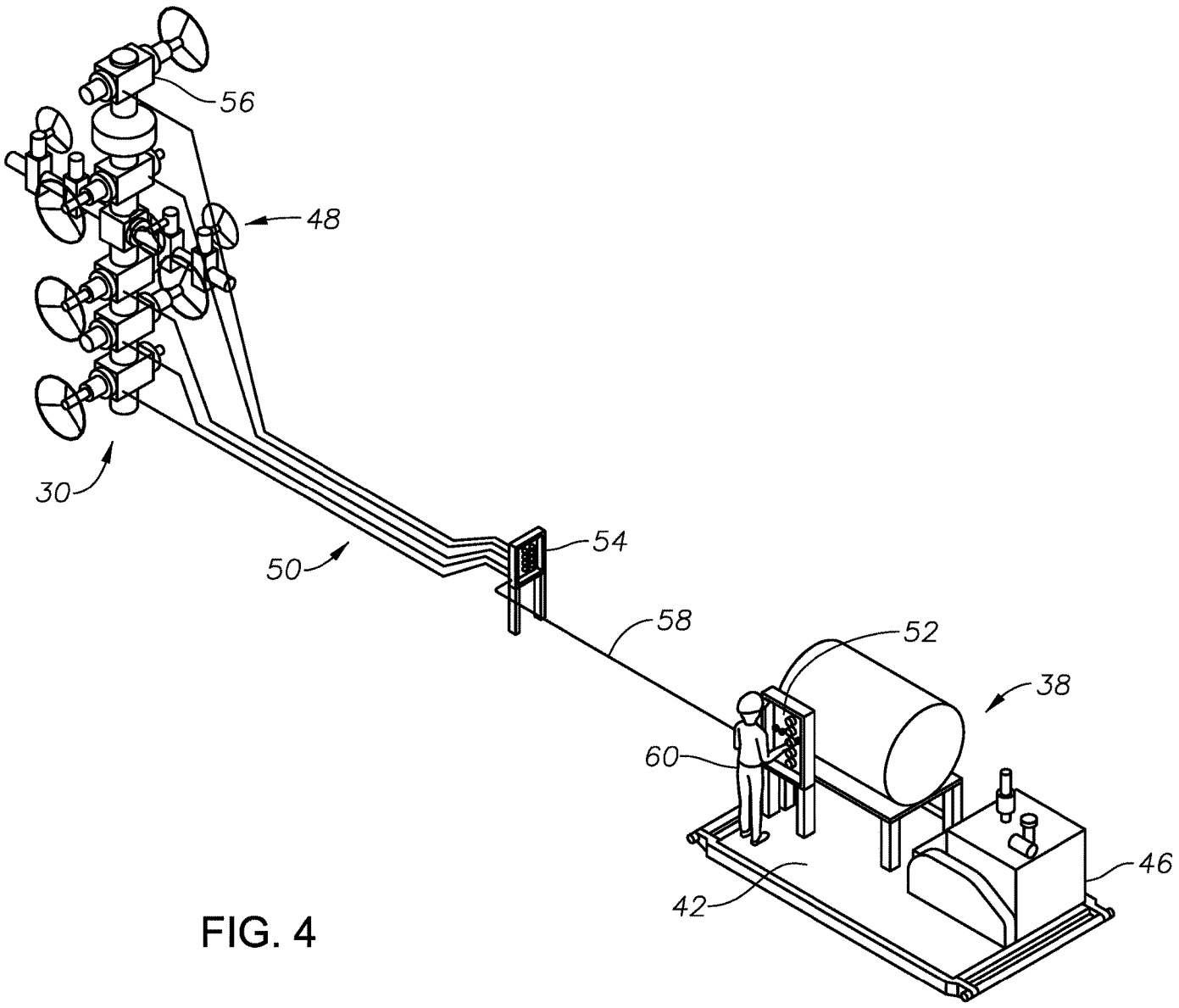
FIG. 4 is a schematic perspective view of an operations center of the remote operations hub of FIG. 1 with a grease skid, in accordance with an embodiment of this disclosure.

Remote operations hub 38 can be in the form of wheeled mobile operation center 40 (FIG. 2) or grease skid 42 (FIG. 4). Looking at FIG. 2, mobile operation center 40, in accordance with an embodiment of this disclosure, can include a tractor trailer or other type of mobile platform 44 upon which system components are mounted. Mobile platform 44 can be located at a safe working distance from wells 30, outside of pressure zone 32.

Remote operations hub 38 can be protected by a blastproof or fire resistant shield to further protect and secure the operators, the system components located on remote operations hub 38, and the data assets. Various system components 46 used to operate and monitor well mounted equipment 48 and characteristic of the well itself during and after fracturing operations can be mounted on remote operations hub 38. Such system components 46 can include: accumulators; hydraulic, electric, and pneumatic actuators; torque wrenches; grease pumps, hydraulic pressure pumps to test equipment during installation and service; pressure, flow, and temperature sensors; odometers; and visual indicators.

System components 46 are used to perform the services at one of the wells 30. The service performed at one of the wells 30 can be, for example, a monitoring operation, a prognostic operation, a diagnostic operation, or the control of well mounted equipment 48 (FIG. 4). As an example, the monitoring, prognostic, and diagnostic operations can include identifying a position of a valve at a well 30, as well as measuring temperatures, pressures, oil and gas ratio, water content, and chemical tracers at the well 30. The monitoring of the valve position can be a secondary valve position system that allows an operator to know with a higher level of confidence if a valve is in an open position or a closed position. This secondary valve position confirmation will reduce incorrect pressurization and washouts. In an alternate example, prognostic operations allow for the measurement of remaining grease in well mounted equipment 48, and provide for pumping grease during hydraulic fracturing operations at a pressure greater than well bore pressure to help maintain the integrity of well mounted equipment 48.

System components 46 can be used to perform the services at one of the wells 30 during and after hydraulic fracturing operations. As an example, after a well 30 is fractured, and as wireline operations are being completed on such well 30, remote maintenance or other service on another well 30 can be undertaken at the same time. This prevents any additional maintenance or service downtime since the operator doesn't have to wait for the wireline operations to complete in order to access the well 30 that is being maintained or serviced.

Well mounted equipment 48 is equipment that is associated with a well 30 and can be located above the surface, such as on a wellhead assembly, or within the wellbore of well 30. Well mounted equipment 48 can include a tree, a manifold, a choke, a valve, an actuator, a separation unit, a flare stack, a pump, a sensor and a compression unit. As an example, a pressure sensor on remote operations hub 38 can be used to sense a pressure within a compression unit mounted on well 30.

In alternate embodiments, instead of monitoring or controlling well mounted equipment 48, a system component 46 can be used to operate and monitor other of the system components 46. As an example, a pressure sensor on remote operations hub 38 can be used to sense a pressure at a hydraulic pressure pump located on remote operations hub 38.

Communication lines 50 (FIGS. 4-5) can be used to provide communication between remote operations hub 38 and each of the wells 30 and can be, as an example, mechanical, pneumatic, hydraulic, electrical, or optical in nature. System components 46 that perform their function with a pressure media can be in communication with well mounted equipment 48 by fluid lines. For example, a hydraulic fluid line can transfer pressurized hydraulic fluid from a hydraulic actuator that is located on remote operations hub 38 to a valve mounted at well 30 so that when the hydraulic actuator is actuated, the valve will move between open and closed positions. In such an embodiment, control valves are tied in to the pressurized fluid lines that extend between remote operations hub 38 and each of the wells 30 to prevent any back flow of pressure.

System components 46 that instead perform their function using an electric or other form of data transmission signal can be in communication with well mounted equipment 48 as well as the computer system with wires or by a wireless telemetry method, such as by radio, microwave, ultrasonic, or infrared systems, as applicable. For example, information relating to the health of well mounted equipment 48 and certain well characteristics, such as pressure, temperature and flow rates can be transmitted to remote operations hub 38 by wires that run between well 30 and the remote operations hub 38, or they can be transmitted to remote operations hub 38 by wireless communication means. Information can also be transferred between various system components 46 using the internet or cloud services, allowing such information to be viewed and utilized at multiple offsite locations, and for commands to be sent from multiple offsite locations. In embodiments where remote operations hub 38 is placed within line of sight from the wells 30, backup confirmation of the service being performed at wells 30 can be observed visually from active or passive optical devices, such as light emitting diodes, using sensors mounted directly on the well mounted equipment 48. If remote operations hub 38 is placed out of line of sight, back up confirmation of the service being performed at wells 30 can be transmitted through wires or wirelessly to remote operations hub 38. In alternate embodiments where the system has telemetry capabilities, there is no restriction how far remote operations hub 38 can be placed from wells 30.

System components 46 can additionally include a computer system that can have a personal computer component with a processing unit and a server component. The server component can include an application server, web server, database server, file server, home server, or standalone server. The hardware of the computer system can access a database to deposit, store, and retrieve data. A memory or computer readable medium can contain software programs with instructions for directing the system components to perform their respective functions. The computer system can be compatible with a common operating system, such as a Microsoft operating system, an Apple operating system, or can utilize a customized operating system.

Figure 3:
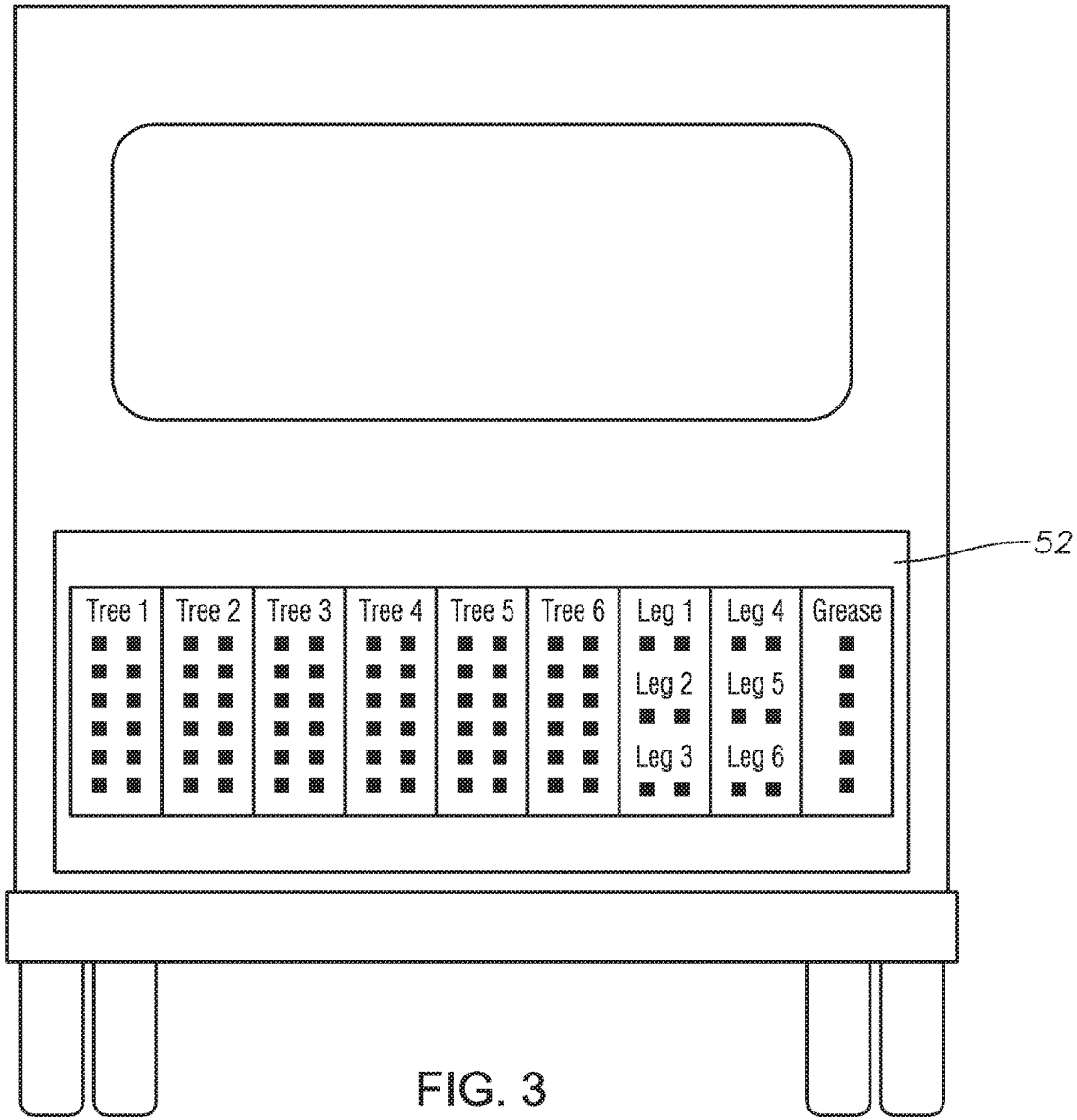
FIG. 3 is a schematic view of a control panel of the wheeled mobile operation center of FIG. 2.

Data obtained by the system components can be indicated on analog or digital visualization platforms or on a graphic user interface of the computer system. Looking at FIG. 3, an example control panel 52 of remote operations hub 38 is shown. In the example of FIG. 3, control panel 52 is shown on a back end of wheeled mobile operation center 40. In the example of FIG. 4, control panels 52 are located on a board of grease skid 42. Control panels 52 can be configured for touch screen operations and can allow for a modular design of well mounted equipment 48 and that allow for straight forward and intuitive operation of remote operations hub 38. Control panels 52 can have a custom graphics display to facilitate ease of use of the control panel system. The control panel 52 can be, as an example, a GE QuickPanel™. Real-time display units of the control panel 52 can communicate information from each of the wells 30. Instructions delivered through control panel 52 can result in immediate real time operations at each of the wells 30.

Control panels 52 can also use controllers that interface with system components 46 for monitoring and directing the system components 46. The controllers can be mechanical, pneumatic, hydraulic, or electrical or can be part of the computer system. As an example of use, real-time display units can communicate information from a flowback section to study production data.

Additional display units can be in communication with the computer system with wires or by a wireless method such as wireless internet service or telemetry method, such as by radio, microwave, ultrasonic, or infrared systems, as applicable. Such additional display units can be for example, a tablet, iPad, cellular phone, or personal computer. Information relating to the position of the valves and the health of well mounted equipment 48 and certain well characteristics, such as pressure, temperature and flow rates can be transmitted to the additional display unit by wires, or they can be transmitted to the additional display unit by wireless communication means. Information can also be transferred between various system components using the internet or cloud services, allowing such information to be viewed and utilized at multiple offsite locations.

Turning to FIG. 4, grease skid 42 can monitor and control remote greasing and remote operations of valves located at each of the wells 30. Greasing the well assemblies during frac operations can reduce failures of the well assembly and fracking operations due to, as an example, washouts, blowouts, incomplete opening and closing of valves, and the failure of seals. In such an embodiment, selector panel 54 is in communication with both grease skid 42 and valves 56 of well 30. In the example of FIG. 4, one or more communication lines 50 travel from control panel 52 to selector panel 54. A series of communication lines 50 travel from selector panel 54 to each well 30. The communication lines 50 can be, for example, a pressure media line or a line for conveying an electrical, optical, or other signal. Selector panel 54 includes a series of relays and other communication directing devices so that information being conveyed to and from remote operations hub 38 and to wells 30 can be appropriately directed to and from the correct well mounted equipment 48.

In an example of greasing operations, after communication lines 50 have been put in place and remote operations hub 38 is operational, the pressure of a pressure media is built up so that a ball valve can be opened to supply grease through a grease supply line 58 to a manifold block. A pump selector can be switched to a desired grease pump, however the grease pump will not run until a valve selector is switched to select the valve to be greased. One valve can be selected at a time to grease valves individually, counting strokes of the grease pump to measure grease flow. A gauge can be monitored to ensure that the valve being greased is not over pressured. After greasing each of the valves of a stack of a wellhead assembly, a needle valve at end of the grease hose can be closed. Caution will be used while disconnecting grease fittings to make sure such fittings do not leak under pressure and pressure will be bled out of the grease system after each greasing operation is complete. Each of these steps can take place by an operator 60 at the grease skid 42, which is located remotely from the well 30 outside of the pressure zone 32, and through use of the control panel 52 on the grease skid 42.

Figure 5:
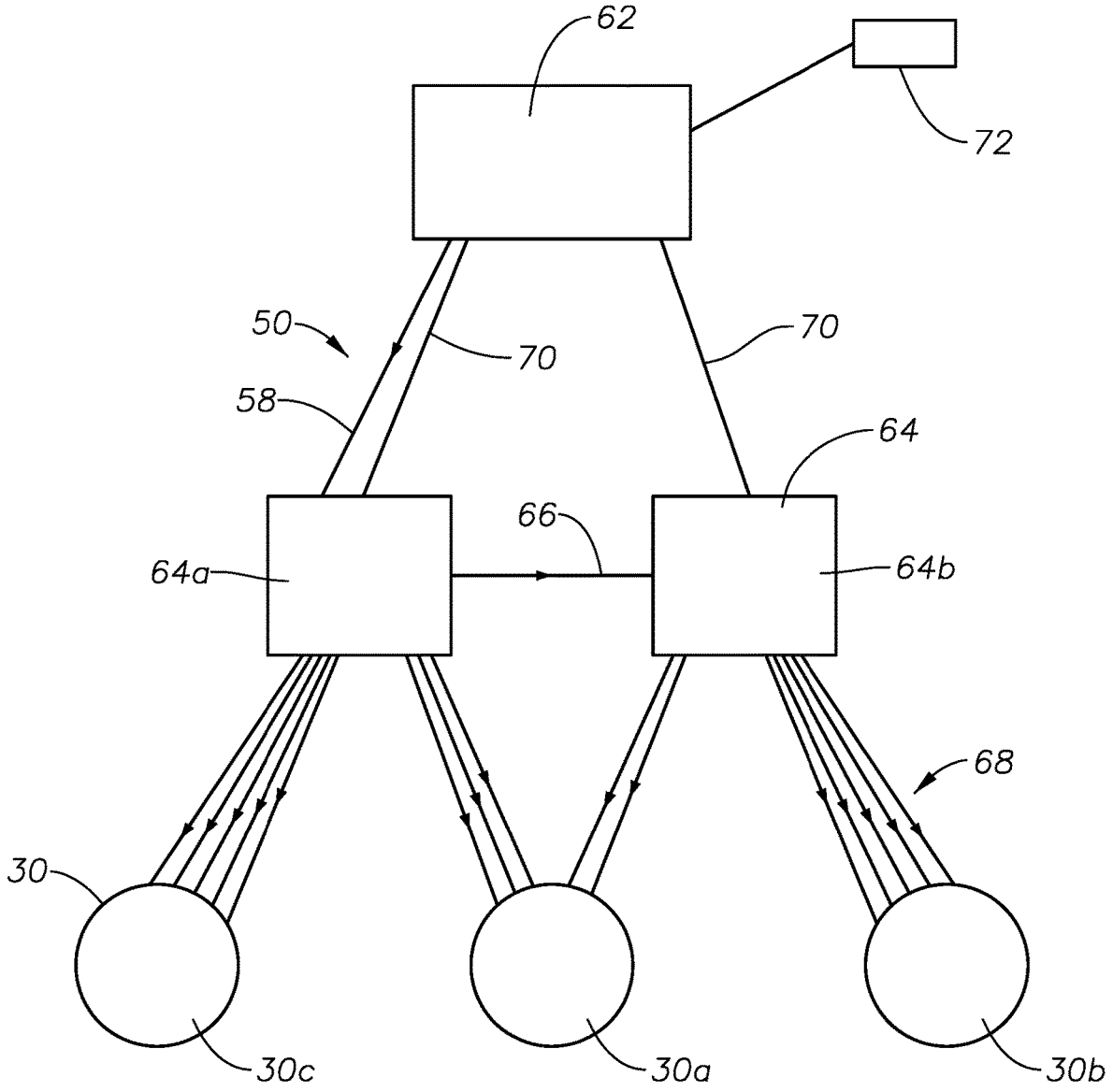
FIG. 5 is a schematic diagram of a remote greasing system in accordance with an embodiment of this disclosure.

Looking at FIG. 5, a schematic diagram showing a system for simultaneously greasing valves at more than one well 30 is shown. In the example of FIG. 5, grease unit 62 is shown associated with two manifold blocks 64. Each manifold block 64 can include a pressure relief system for relieving pressure from the grease unit in a safe manner. Each grease unit 62 can alternately include a flow meter, a dedicated 110*v* power supply, and have a multi-position switch for controlling multiple separate manifold blocks 64.

A first manifold block 64*a* is associated with a first well 30*a* and a third well 30*c*. A second manifold block 64*b* is associated with first well 30*a* and second well 30*b*. Grease supply line 58 extends from grease unit 62 to the first manifold block 64*a*. Another grease supply line, grease crossover line 66, extends from first manifold block 64*a* to second manifold block 64*b*. Additional grease supplies lines 68 extend from first manifold block 64*a* to first well 30*a* and to third well 30*c*, and extend from second manifold block 64*b* to first well 30*a* and to second well 30*b*. In such a configuration, grease can be supplied between manifold blocks 64 through a grease outlet to daisy chain grease supply. In the example schematic of FIG. 5, grease is provided between two manifold blocks 64. In alternate embodiments, three or more manifold blocks 64 can be connected or daisy chained in such a manner.

Each of the additional grease supply lines 68 can extend to a different valve at one of the wells 30. In the example of FIG. 5, five additional grease supply liens 68 are shown extending to each well 30, each of which additional grease supply liens 68 can be associated with a different valve of a well 30. In alternate embodiments, up to ten valves can be serviced and controlled from each manifold block 64. In yet other embodiments, there is no restriction on the number of valves or number of wells 30 than can be connected to remote operations hub 38 or to grease unit 62 and there is no limit to the number of valves that can be controlled or services that can be performed at well mounted equipment 48 at the same time.

Separate umbilicals or electrical lines 70 extend between grease unit 62 and each of the manifold blocks 64 for communicating signals and information between grease unit 62 and each of the manifold blocks 64. A separate remote controller 72, such as a pendant controller, can be used to communicate with grease unit 62. Wire mesh style strain relief systems can be used on both ends of a cable between separate remote controller 72 and grease unit 62 and on electrical lines 70. A visual identification system, such as colors, numbers, or other markings, can be used on grease supply line 58, grease crossover line 66, additional grease supplies lines 68, on the cable between separate remote controller 72 and grease unit 62, and on electrical lines 70 to help to visually distinguish between such lines in an efficient manner.

In an example of operation of grease unit 62, while hydraulic fracturing operations are being undertaken at first well 30*a*, a valve at each of the second and third wells 30*b*, 30*c* can be selected for greasing. Signals can be provided to first and second manifold blocks 64*a*, 64*b* by way of electrical lines 70 to select such valves. Grease can then be supplied through grease supply line 58 to first manifold block 64*a* and to second manifold block 64*b* through crossover line 66. First and second manifold blocks 64*a*, 64*b* can then simultaneously provide grease to the selected valves through the applicable grease supply lines 68.

Systems and methods described herein provide a range of functionality. Embodiments of the current disclosure provide systems and methods for valves and other well mounted equipment 48 to be remotely controlled and operated from control panels inside the trailer. Production characteristics, such as pressure, oil and gas ratio, water content, and chemical tracers, which provide information regarding the reservoir and efficiency of fracturing, can be observed in real-time allowing fracturing operators to modify the fracturing program in real-time. In addition, the drag characteristics and health of the valves can be monitored, and a programmed or manual re-grease protocol to improve equipment performance can be initiated. Data gathered by system components 46 can be used for preventative maintenance or pre-emptive actions, such as for the replacement of parts. Equipment diagnostics can be used to predict repair and failure life span. Bolt torque can be monitored by the system components for a stretch in bolts to identify re-torque requirements. Flexible controls at the mobile platform allow individual or group controls of well mounted equipment, such as trees, chokes, valves, on one or on a plurality of wells. With one push of a button, one can kill all pressure lines and isolate sections of the well or equipment as desired.

Embodiments of this disclosure can monitor, prognose, and diagnose operations at the well assembly and can therefore reduce the number of grease interference in hydraulic fracturing operations. In addition, the well assemblies can be greased remotely, allowing for continued fracking in a second well while a current first well assembly is being greased. Data gathered by the system components can be used for preventative maintenance or pre-emptive actions, such as for the replacement of parts. The diagnostics and prognostics operations can be used to predict repair and failure life span.

In some current hydraulic fracturing operations, human operators are required to be around pressurized equipment where there have been instances of physical harm. Remote operation removes the operator from the vicinity of high pressure equipment and improves safety. In addition, the mobile operation and diagnostic center can be equipped with multiple redundancies of operators, controls, and actuators which can be used as fail-safe measures in case of equipment failure or unforeseen behavior from the well or attached equipment.

The diagnoses of system conditions by system components of embodiments of this disclosure can reduce the number of grease interference in hydraulic fracturing operations. In addition, the trees can be greased remotely, allowing for continued fracking in a second well while a current first well is being greased.

The terms "vertical", "horizontal", "upward", "downward", "above", and "below" and similar spatial relation terminology are used herein only for convenience because elements of the current disclosure may be installed in various relative positions.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A system for remotely controlling services to a well during hydraulic fracturing operations, comprising:

a remote operations hub in communication with equipment operating at a first well and a second well, the first and second well having at least partially overlapping pressure zones, wherein the remote operations hub is configured to control at least one of a monitoring operation, a prognostic operation, or a diagnostic operation on equipment arranged at a surface location of the second well during operation of a high pressure pumping system at the first well, the remote operations hub being located outside of the respective pressure zones.

2. The system of claim 1, wherein the equipment is selected from a group consisting of a tree, a manifold, a choke, a valve, an actuator, a separation unit, a flare stack, a pump, a sensor and a compression unit.

3. The system of claim 1, wherein both the first well and the second well are configured to receive high pressure fluid for fracturing operations.

4. The system of claim 1, wherein the remote operations hub comprises a grease skid, the grease skid performing at least one of the monitoring operation, the prognostic operation, or the diagnostic operation.

5. The system of claim 1, wherein the at least one of the monitoring operation, the prognostic operation, or the diagnostic operation includes greasing a valve of a wellhead assembly of the second well.

6. The system of claim 1, further comprising at least one of a blast-proof or fire resistant shield coupled to the remote operations hub.

7. The system of claim 1, further comprising system components incorporated into the remote operations hub, the system components communicatively coupled to the equipment using electric or digital signal transmission.

8. The system of claim 1, wherein the remote operations hub is fluidly coupled to the equipment.

9. The system of claim 1, further comprising:

a manifold block coupled to the remote operations hub, wherein the manifold block is fluidly coupled to both the first well and the second well, the manifold block receiving a fluid from the remote operations hub and distributing the fluid to the first well and the second well.

10. The system of claim 9, wherein the remote operations hub is a grease skid and the manifold block comprises a first plurality of lines extending to first well and a second plurality of line extending to the second well.

11. A system for remotely controlling services to a well during hydraulic fracturing operations, comprising:

a remote operations hub positioned outside of a pressure zone at a hydraulic fracturing site, the pressure zone including an area around a first well undergoing fracturing operations, wherein the remote operations hub is in communication with the first well and a second well, the second well positioned within the pressure zone, to control at least one of a monitoring operation, a prognostic operation, or a diagnostic operation on well-mounted equipment at both the first well and the second well during operation of a high pressure pumping system at the first well; and a control panel associated with the remote operations hub, the control panel operable to initiate at least one of the monitoring operation, the prognostic operation, or the diagnostic operation.

12. The system of claim 11, wherein the equipment is selected from a group consisting of a tree, a manifold, a choke, a valve, an actuator, a separation unit, a flare stack, a pump, a sensor and a compression unit.

13. The system of claim 11, wherein the control panel includes a touch screen for operations and provides operational feedback regarding at least one of the first well or the second well.

14. The system of claim 11, wherein the remote operations hub comprises a grease skid, the grease skid performing at least one of the monitoring operation, the prognostic operation, or the diagnostic operation.

15. The system of claim 14, wherein the at least one of the monitoring operation, the prognostic operation, or the diagnostic operation includes greasing a valve of a wellhead assembly of the second well.

16. The system of claim 11, further comprising at least one of a blast-proof or fire resistant shield coupled to the remote operations hub.

17. The system of claim 11, further comprising system components incorporated into the remote operations hub, the system components communicatively coupled to the equipment using electric or digital signal transmission.

18. The system of claim 11, wherein the remote operations hub is fluidly coupled to the equipment.

19. The system of claim 11, further comprising:

a manifold block coupled to the remote operations hub, wherein the manifold block is fluidly coupled to both the first well and the second well, the manifold block receiving a fluid from the remote operations hub and distributing the fluid to the first well and the second well.

20. The system of claim 19, wherein the remote operations hub is a grease skid and the manifold block comprises a first plurality of lines extending to first well and a second plurality of line extending to the second well.

* * * * *